US009739121B2

(12) United States Patent
Thomson

(10) Patent No.: US 9,739,121 B2
(45) Date of Patent: Aug. 22, 2017

(54) MORPHING TUBULARS

(71) Applicant: SCHLUMBERGER TECHNOLOGY CORPORATION, Sugar Land, TX (US)

(72) Inventor: Neil Thomson, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/867,066

(22) Filed: Sep. 28, 2015

(65) Prior Publication Data

US 2016/0097263 A1 Apr. 7, 2016

(30) Foreign Application Priority Data

Oct. 3, 2014 (GB) ..... 1417556.6

(51) Int. Cl.
*E21B 43/10* (2006.01)
*E21B 23/04* (2006.01)
(Continued)

(52) U.S. Cl.
CPC ..... *E21B 43/105* (2013.01); *E21B 23/04* (2013.01); *E21B 33/124* (2013.01); *E21B 43/108* (2013.01); *F15B 3/00* (2013.01)

(58) Field of Classification Search
CPC ..... E21B 43/105; E21B 43/108; E21B 23/04; E21B 23/06
See application file for complete search history.

(56) References Cited

U.S. PATENT DOCUMENTS 3,460,618 A * 8/1969 Blagg ..... E21B 23/06 166/184
5,343,956 A * 9/1994 Coronado ..... E21B 33/127 166/123

(Continued)

FOREIGN PATENT DOCUMENTS

EP 1138872 A1 10/2001
EP 2565368 A1 3/2013

(Continued)

OTHER PUBLICATIONS

United Kingdom Intellectual Property Office Search Report for GB1517256.2; Jan. 14, 2016; UK IPO; Great Britain; entire document.

(Continued)

*Primary Examiner* — Matthew R Buck
*Assistant Examiner* — Aaron Lembo

(57) ABSTRACT

A pressure intensifier for morphing tubulars downhole. An elongate mandrel defines an inner bore, being co-axially located within an elongate hollow outer cylindrical body to form a co-axial annular bore therebetween. Pistons are mounted upon the mandrel with each piston having an annular fluid facing face extending across the annular bore, with fluid communication between the inner bore and the annular bore to act upon each face. Stops are located on an inner surface of the outer cylindrical body to limit travel of each piston. A morph fluid is located in the annular bore between an opposing face of a first piston and a first stop, with the first stop having delivery ports to deliver the morph fluid at a greater pressure than the pressure of fluid delivered through the inner bore.

13 Claims, 3 Drawing Sheets

(51) Int. Cl.
*F15B 3/00* (2006.01)
*E21B 33/124* (2006.01)

(56) References Cited

U.S. PATENT DOCUMENTS 6,976,536 B2 * 12/2005 Simpson ..... B21D 26/033 166/207
7,145,471 B2 * 12/2006 Purkis ..... E21B 23/04 166/250.15
7,665,532 B2 * 2/2010 Cook ..... B21D 39/203 166/207
7,735,567 B2 * 6/2010 O'Mally ..... E21B 33/1208 166/179
7,908,732 B2 * 3/2011 Alliot ..... F16L 13/0263 228/44.5
7,967,064 B2 * 6/2011 Cook ..... E21B 43/103 166/207
8,950,505 B2 * 2/2015 Themig ..... E21B 33/1285 166/120
9,010,435 B2 * 4/2015 Matsur ..... E21B 33/02 166/285
2003/0024711 A1 * 2/2003 Simpson ..... B21D 26/033 166/384
2003/0037932 A1 * 2/2003 Guillory ..... E21B 23/06 166/387
2003/0116328 A1 6/2003 Doane et al.
2005/0230104 A1 * 10/2005 Cook ..... B21D 39/203 166/207
2007/0271981 A1 * 11/2007 Cook ..... E21B 33/10 72/58
2008/0053656 A1 * 3/2008 Lynde ..... E21B 29/10 166/277
2010/0018694 A1 * 1/2010 Kunz ..... E21B 33/128 166/179
2010/0101072 A1 * 4/2010 Cook ..... E21B 43/103 29/523
2012/0211222 A1 * 8/2012 Leighton ..... E21B 29/10 166/208
2013/0233574 A1 * 9/2013 Themig ..... E21B 33/1285 166/387
2014/0054047 A1 2/2014 Zhou
2015/0218903 A1 * 8/2015 Sellers, Jr. ..... F16J 15/164 166/380
2016/0245052 A1 * 8/2016 Clemens ..... E21B 29/10

FOREIGN PATENT DOCUMENTS

EP 2570588 A1 3/2013
WO WO 03/076763 A1 9/2003

OTHER PUBLICATIONS

International Search Report and Written Opinion for PCT/GB2015/052853; Feb. 2, 2016; EPO as International Search Authority; entire document.

* cited by examiner

MORPHING TUBULARS

The present invention relates to an apparatus and method, particularly but not exclusively, for assisting in deploying and/or securing a tubular section referred to as a "tubular member" within a liner or borehole.

Oil or gas wells are conventionally drilled with a drill string at which point the open hole is not lined, hereinafter referred to as a "borehole". After drilling, the oil, water or gas well is typically completed thereafter with a casing or liner and a production tubing, all of which from here on are referred to as a "tubular".

Conventionally, during the drilling, production or workover phase of an oil, water or gas well, there may be a requirement to provide a patch or temporary casing across an interval, such as a damaged section of liner, or an open hole section of the borehole. Additionally, there may be a requirement to cut a tubular (such as a section of casing) downhole, remove the upper free part and replace it with a new upper length of tubular in an operation know as "tie back" or 'casing reconnect' and in such a situation it is important to obtain a solid metal to metal seal between the lower "old" tubular section and upper "new" tubular section. Further, there may be a requirement to create an isolation barrier between two zones in an annular space in a well.

The present applicants have developed a technology where a tubular metal portion is forced radially outwardly by the use of fluid pressure acting directly on the portion. Sufficient hydraulic fluid pressure is applied to move the tubular metal portion radially outwards and cause the tubular metal portion to morph itself onto a generally cylindrical structure in which it is located. The portion undergoes plastic deformation and, if morphed to a generally cylindrical metal structure, the metal structure will undergo elastic deformation to expand by a small percentage as contact is made. When the pressure is released the metal structure returns to its original dimensions and will create a seal against the plastically deformed tubular metal portion. During the morphing process, both the inner and outer surfaces of the tubular metal portion will take up the shape of the surface of the wall of the cylindrical structure. This morphed tubular is therefore ideally suited for creating a seal between a liner and previously set casing or liner which is worn and presents an irregular internal surface. The morphed tubular metal portion may also be a sleeve if mounted around a supporting tubular body, being sealed at each end of the sleeve to create a chamber between the inner surface of the sleeve and the outer surface of the body. A port is arranged through the body so that fluid can be pumped into the chamber from the throughbore of the body. This morphed isolation barrier is ideally suited for creating a seal between a tubular string and an open borehole.

WO2007/119052 and WO2012/127229, both to the present Applicants, show assemblies based on morphing one tubular within another. A morphed isolation barrier is disclosed in U.S. Pat. No. 7,306,033, which is incorporated herein by reference.

In order to morph the tubular metal section in a wellbore, fluid at a high pressure must be delivered to the location. It will be appreciated that the location may be thousands of feet in depth and thus pumping fluid from the surface will have drawbacks in that, the fluid pressure will reduce with depth and cannot be adequately calculated to ensure sufficient morphing pressure is reached. Additionally, it may not be desirable to pump such high fluid pressure through the tubing string for many well designs.

To overcome this, the present applicants have proposed a hydraulic fluid delivery tool which can be run into the string from surface by means of coiled tubing or other suitable method. The tool is provided with upper and lower seals, which are operable to radially expand and seal against the inner surface of the string at a pair of spaced apart locations in order to isolate an internal portion of the string between the seals at the desired location. Fluid at high pressure can then be delivered to the location via a port in fluid communication with the interior of the string.

For deep water projects a pressure intensifier is typically coupled to the hydraulic fluid delivery tool to increase the fluid pressure for morphing. There are a number of disadvantages in using a pressure intensifier downhole. Space is the first difficulty to overcome as it is generally preferable to maintain a central bore through the hydraulic fluid delivery tool. The multiple strokes required to create sufficient fluid pressure increase the time required to morph the tubular and require downhole control. Further, these devices tend to have multiple components which are complex to manufacture and consequently risk failure.

It is an object of the present invention to provide a pressure intensifier for morphing tubulars downhole which obviates or mitigates at least some of the disadvantages of the prior art.

According to a first aspect of the invention there is provided a pressure intensifier for morphing tubulars downhole, the pressure intensifier comprising:

- an elongate mandrel defining an inner bore, the mandrel being co-axially located within an elongate hollow outer cylindrical body to form a co-axial annular bore therebetween;
- at least one piston mounted upon the mandrel, each piston having an annular fluid facing face extending across the annular bore;
- at least one input port to enable fluid communication between the inner bore and the annular bore to act upon each face;
- at least one stop located on an inner surface of the outer cylindrical body to limit travel of each piston;
- morph fluid located in the annular bore between an opposing face of a first piston and a first stop;
- wherein the first stop includes one or more delivery ports to deliver the morph fluid at a greater pressure than the pressure of fluid delivered through the inner bore.

In this way, a fluid pumped under pressure down the inner bore will create a force, used to move the piston(s), which in turn creates a morph fluid at increased pressure to achieve morphing of a tubular downhole.

Preferably, there is a plurality of pistons arranged along the mandrel. In this way, as the total force is the sum of force from all the pistons, the pressure of the morph fluid can be increased without increasing the pressure of fluid pumped downhole. Additionally, this arrangement allows the morph to be completed on a single stroke.

Preferably, the outer cylindrical body has a first inner diameter which defines a first volume of the annular bore between adjacent stops and wherein, the outer cylindrical body has a second inner diameter at the location of the morph fluid, the second inner diameter being less than the first inner diameter. In this way, the outer cylindrical body can be thicker-walled to prevent the possibility of burst by the increased pressure of the morph fluid.

Preferably, the intensifier includes a locking mechanism, the locking mechanism being arranged to hold the mandrel and pistons in a first position until a morph is required. In this way, fluids can be delivered through the inner bore for other operations without causing morphing to occur.

Preferably, the intensifier includes a hydraulic fluid delivery tool, the tool comprising upper and lower seals, the seals being operable to radially expand and seal against an inner surface of a tubular at a pair of spaced apart locations in order to isolate an internal portion of the tubular between the seals at a desired location, so that morph fluid can be delivered at high pressure to the location. The morph fluid may morph the tubular between the upper and lower seals. Alternatively the morph fluid may pass through a port in the tubular and enter a chamber formed by a further tubular arranged as a sleeve on the tubular, the morph fluid morphing the further tubular. In this way, the volume of morph fluid in the intensifier can be selected to ensure sufficient morph pressure at the location to morph the tubular.

More preferably, the delivery ports are arranged to deliver the morph fluid to the location. In this way, by stroking the tool, morphing can be achieved quickly and in a single stoke.

Additionally, the delivery ports may be arranged to deliver morph fluid to a pressure distribution tool which provides morph fluid under pressure to operate the upper and lower seals prior to delivering morph fluid to the location. In this way, a hydraulic fluid delivery tool or morph tool can be entirely operated in a single stroke.

According to a second aspect of the present invention there is a method of morphing a tubular downhole, comprising the steps:

(a) connecting a hydraulic fluid delivery tool to a pressure intensifier, the pressure intensifier according to the first aspect;
(b) positioning the hydraulic fluid delivery tool at a location in the tubular;
(c) flowing fluids through the inner bore of the pressure intensifier;
(d) passing fluid through the input port(s) to apply a pressure upon the annular fluid facing face(s) of the pistons(s);
(e) forcing the mandrel and pistons along the cylindrical outer body until the piston(s) reaches a stop;
(f) driving morph fluid out of the delivery port(s) at a desired morph pressure by movement of the first piston towards the first stop; and
(g) delivering morph fluid to the location and morphing the tubular.

In this way, fluid pressure pumped downhole creates a force to move the pistons and mandrel, which then creates a pressure of fluid to morph the tubular. This is in contrast to prior art intensifiers which typically are arranged to use fluid pressure pumped downhole to only create a force.

Preferably, the method includes the step of selecting a number of pistons dependent upon the morph pressure required. In this way, morphing the tubular is achieved on a single stroke of the intensifier mandrel.

Preferably, the method includes the step of retaining the mandrel and piston(s) in a first position while delivering fluid through the inner bore. In this way, fluid under pressure is available in the wellbore for other purposes prior to morphing.

Preferably, the method includes the step of retaining the mandrel and piston(s) in a first position while running a further string through the inner bore. In this way, other intervention such as the running of tools can be achieved while the pressure intensifier is in the wellbore.

Preferably, the method includes the steps of:

(a) conducting a first stage release of the mandrel at a preset fluid pressure in the inner bore;
(b) bleeding down fluid pressure in the inner bore to provide a second stage release; and
(c) operating the pressure intensifier on fluid pressure in the inner bore being increased again.

In an embodiment, the morph fluid morphs the tubular between the upper and lower seals. Alternatively the morph fluid may pass through a port in the tubular and enter a chamber formed by a further tubular arranged as a sleeve on the tubular, the morph fluid morphing the further tubular. In this way, the pressure intensifier can be used on a morphed isolation barrier.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. All positional terms such as 'up' and 'down', 'left' and 'right' are relative and apply equally in opposite and in any direction.

Embodiments of the present invention will now be described, by way of example only, with reference to the accompanying drawings in which.

Figure 1:
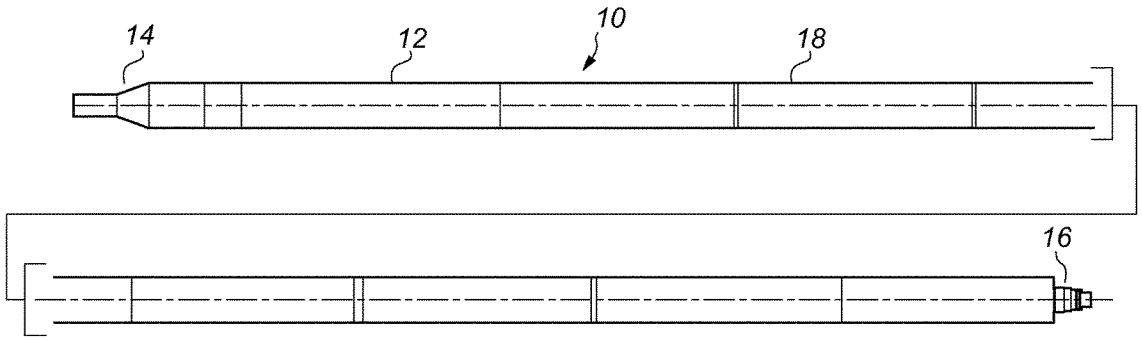
FIG. 1 is a side view of a pressure intensifier according to an embodiment of the present invention.

Referring initially to FIG. 1 there is provided a pressure intensifier, generally indicated by reference numeral 10, for morphing tubulars downhole according to an embodiment of the present invention.

The pressure intensifier 10 comprises a cylindrical body 12 provided with a first end 14, a second end 16 and outer cylindrical wall 18. The ends 14, 16 are provided with suitable fittings as are known in the art for connecting the tool 10 into a string 92 for running the tool 10 into a wellbore. Suitable strings may be coiled, tubing, drill pipe, liner and the like.

Figure 2:
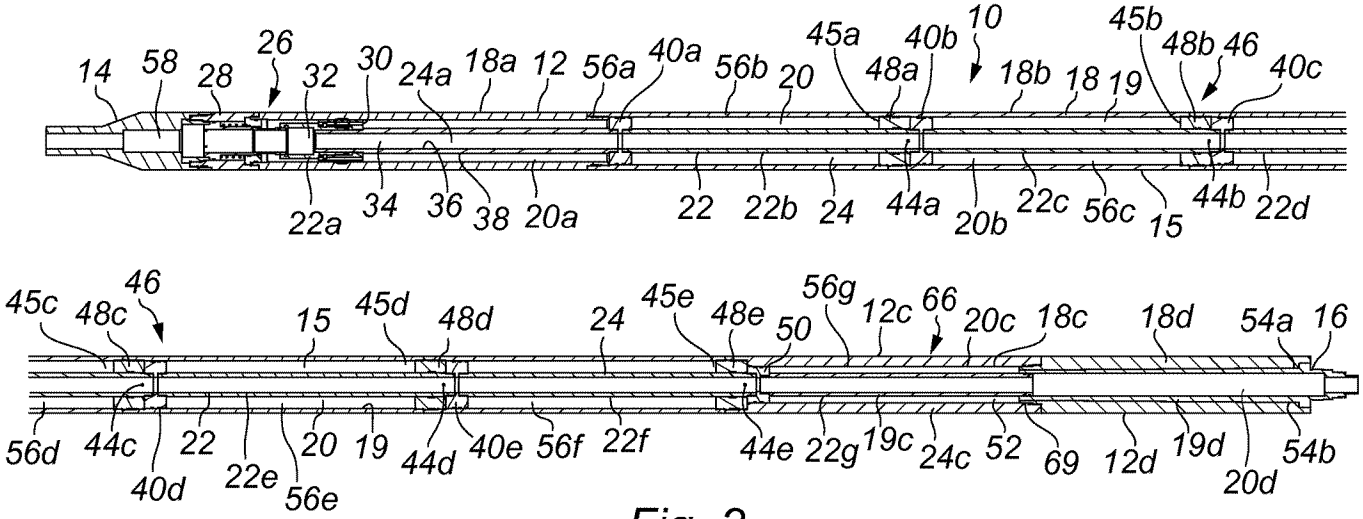
FIG. 2 is a cross section of a side view of the pressure intensifier of FIG. 1 in a first state according to an embodiment of the present invention.

Pressure intensifier 10 is shown in further detail in FIG. 2 in which the pressure intensifier 10 is shown in cross section along longitudinal axis A of FIG. 1. Cylindrical body 12 is of metal construction and is a substantially hollow tubular having a cylindrical wall 18 with an inner surface 19 defining a bore 20 therethrough. Within bore 20 is arranged co-axially a mandrel 22, also of metal construction, having outer surface 24 such that bore 20 is substantially annular in shape.

At first end 14, arranged within the cylindrical body 12 is provided a locking mechanism 26, a pressure development mechanism 46 is formed in the central length 15 of the cylindrical body 12 and a pressure application mechanism 66 is formed at the second end 16 of the cylindrical body 12.

The locking mechanism 26 includes a pressure management mechanism 28, a first end 22*a* of the central mandrel 22, a drive piston 30 and a retaining mechanism 32. The pressure management mechanism facilitates management of fluid communication between fluid in the tubular string 92 and the pressure intensifier 10 and may be any known component which is operable to allow through flow of pressurised fluid to the pressure intensifier 10 when the pressure intensifier 10 is set in position for operation. The drive piston 30 is mounted on the outer surface 24 of the first end 22*a* of the mandrel 22 and forms a moveable seal between the annular bore 20 and the pressure management mechanism 26. The first end 22*a* is a hollow cylinder with a mandrel bore 34 defined by inner surface 36 of mandrel wall 38.

In the pressure development mechanism 46, the central mandrel 22 continues through cylindrical body 12 and is provided along its mid-length with actuating pistons 40 which are spaced equidistantly apart. In the embodiment shown, five actuating pistons 40*a-e* are shown and each are associated with a segment of mandrel 22*b-f* respectively. The pistons 40 are annular discs which project perpendicularly from the outer surface 24 of mandrel 22 and extend across the bore 20 to inner surface 19 of cylindrical body 12. The mandrel 22 is further provided with ports 44 spaced equidistantly apart along the length of the mandrel. In this case, five ports, 44*a-e* are shown. The pressure development mechanism 46 further includes annular stop mechanisms 48 which are spaced equidistantly apart on the inner surface 19 of cylindrical body 12. In the embodiment shown five annular stop mechanisms 48*a-e* are provided. The stop mechanisms extend perpendicularly from inner surface 19 of cylindrical body 12, across bore 20 to outer surface 24 of mandrel 22. Located towards the first end 14 beside each stop 48 there is a port 45 which extends through the wall 18*b* of the body12. There are five ports 45*a-e* arranged beside each stop 48.

In pressure application mechanism 66 the cylinder 12 is provided with a segment 12*c* having a cylindrical wall 18*c* thicker than the cylinder wall sections 18*a*, 18*b* resulting in annular bore section 20*c* having an outer diameter less than the outer diameter of annular bore 20*a*, 20*b*. Mandrel 22 continues coaxially through cylinder 12 with mandrel segment 22*g* having the same inner and outer diameter as mandrel segments 22*a-f* to provide a continuous bore 34 through the intensifier 10. At a first end, the mandrel section 22*g* is provided with an application piston 50 which extends perpendicularly from the outer surface 24 across annular bore 20*c* to form a moveable seal with inner surface 19*c* of cylindrical wall 18*c*. Bore 20*c* is provided with application fluid 52 which may be any suitable fluid, such as, for example, clean water, for providing to a hydraulic fluid delivery tool 96 such as a morph tool which enables a discreet section of wall of a tubular to be deformed using the localised application of hydraulic fluid pressure. The segment 12*d* of cylindrical body 12 in pressure application mechanism 66 has cylindrical wall inner surface 19*d* which defines bore 20*d*, the wall 18*d* is of such a thickness that the outer diameter of bore 20*d* is substantially the same as the outer diameter of mandrel 22 such that wall end 69 is operable to act as a piston stop. The wall 18*d* is provided with formed cylindrical application bores 54, in this case two application bores 54*a,b* which pass through the body of wall 18*d* in parallel with bore 20*d*. The bores 54*a*, 54*b* are operable to provide fluid communication between annular bore 20*c* and a hydraulic fluid delivery tool 96 (shown in FIG. 5).

The pressure intensifier 10 is operable to have two states. In the first state, the components of the intensifier are arranged in a first position as is shown in the embodiment illustrated in FIG. 2. The intensifier 10 is in a first state prior to actuation of the mechanism 10 to apply pressure to a tool 96.

In the first state, the drive piston 30 is arranged to abut against pressure management mechanism 28 and secured in position by retaining mechanism 32 which may be any suitable type of retaining mechanism including, but not limited to, locking dogs. Central mandrel segment bore 24*a* is operable to be in fluid communication with pressure management mechanism 32 and projects from drive piston 30 at the first end 14 along the bore 20 of cylindrical body 12 towards end 16.

The central mandrel section 22*b* is arranged to continue on in fluid communication with section 22*a* and first actuating piston 40*a* is arranged such that it is placed on mandrel segment 22*b* where it joins segment 22*a*. The inner surface 19, outer surface 24, drive piston 30 and actuating piston 40*a* co-operate in the first state so as to form a chamber 56*a*. The first actuating piston 40*a* is arranged so that it is spaced remotely along the bore 20 from stop 48*a* which is arranged to correspond with the distal end of mandrel segment 22*b*. The actuating piston 40*a*, inner surface 19, outer surface 24 and stop 48*a* co-operate in the first state to form a chamber 56*b*.

Similarly, the central mandrel section 22*c* is arranged to continue on in fluid communication with section 22*b* and actuating piston 40*b* is arranged such that it is placed on mandrel segment 22*c* where it joins segment 22*b*. The actuating piston 40*b* is arranged spaced remotely along the bore 20 from stop 48*b* which is arranged to correspond with the distal end of mandrel segment 22*c*. The actuating piston 40*b*, inner surface 19, outer surface 24 and stop 48*b* co-operate in the first state to form a chamber 56*c*. Similarly, chambers 56*d-f* are also formed along the central length 15.

Application piston 50 is arranged mounted upon mandrel segment 22*g* such that in a first state it is closely adjacent to stop 48*e* and that mandrel segment 22*g* projects along bore 20*c* toward second end 16. The application piston 50, outer surface 24, inner surface 19 and bore stop 69 co-operate in the first state to form a chamber 56*g* which is filled with morph fluid 52.

Figure 3:
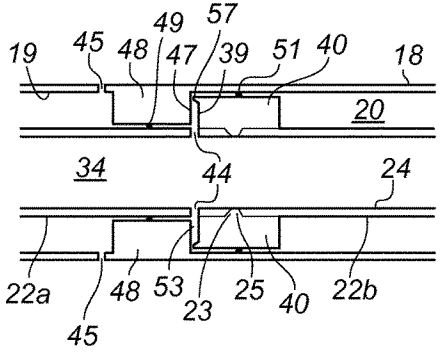
FIG. 3 is an exploded view of a part of FIG. 2.

In FIG. 3, a detail of a piston 40 and stop mechanism 48 in the first state prior to actuation, as shown in FIG. 2, is illustrated. The stop mechanism 48 projects perpendicularly from inner surface 19 of cylindrical wall 18 across bore 20 toward outer surface 24 of mandrel 22. The distal end surface of stop 48 is provided with a resilient seal ring 49, such as a rubber or elastomeric o-ring or similar, that provides a resilient seal between the stop mechanism 48 and the mandrel wall 24. The seal 49 allows lateral movement between the mandrel wall 24 and the stop mechanism 48 whilst preventing the passage of fluid therebetween.

The piston 40 is attached to the mandrel 22 by a screw mechanism 23. The screw mechanism may co-operate with the mandrel surface such that the piston 40 acts as a joining mechanism between adjacent mandrel segments 22*a* and 22*b* with a lug 25 projecting from piston towards bore 34 and abutting between mandrel segment 22*a* and mandrel segment 22*b* so as to stabilise the joint and form part of the continuous mandrel wall that defines bore 34. The piston 40 projects perpendicularly from outer surface 24 of mandrel 22 toward inner surface 19 of cylindrical wall 18 across bore 20. The distal end surface of piston 40 is provided with a resilient seal ring 51, such as a rubber or elastomeric o-ring or similar, that provides a resilient seal between the piston 40 and the cylinder inner wall surface 19. The seal 51 allows lateral movement between the cylinder wall 19 and the piston 40 whilst preventing the passage of fluid therebetween. Stop mechanism wall 47, piston face 39, inner surface 19 and outer surface 24 co-operate together in the first state to define a chamber 53 which is substantially smaller than chamber 59. Port 44 is arranged such that in the first state, the port 44 enables fluid communication between mandrel bore 34 and chamber 53. A lug 57 is provided on the piston face 39 so as to allow fluid to enter the port 44 and act on the piston face 39.

Upon actuation, the moveable components of intensifier 10, through the process of receiving and applying fluid under pressure, move to a second state. The arrangement of the components in the second state is shown in FIG. 4.

In use, fluid travelling through the tool string 92 from surface enters the first end 14 of the mechanism 10. When the fluid is required for the hydraulic fluid delivery tool 96, fluid pressure from surface is adjusted in a given sequence to release the locking mechanism 26. For example, there may be an interlocking feature with first stage of mandrel release at preset pressure and second stage of release when pressure is bled down. Full release will occur when pressure is increased again. On release, the actuation mechanism is activated and retaining mechanism 32 releases drive piston 30. Hydraulic fluid pressure is applied to piston 30 and as the increased fluid pressure enters the ports 44 it fills chambers 53. As the pressure develops further, pressure begins to grow in chambers 53 acting upon pistons 40. When the pressure in the bore 34 and chambers 53 grows sufficiently to overcome the pressure in chambers 56 on the opposing side of the piston 40 to chamber 53, the mandrel 22 and pistons 30, 40, 50 are driven forward such that the force is transmitted through central mandrel 22 which transmits the force to bottom piston 50. Fluid in chambers 56 can escape through the ports 45 to the wellbore. Application piston 50 then acts upon the morph fluid 52. The movement of mandrel end 22*g* forward into bore 20*c* forces the fluid 52 into the application bores 54.

Figure 4:
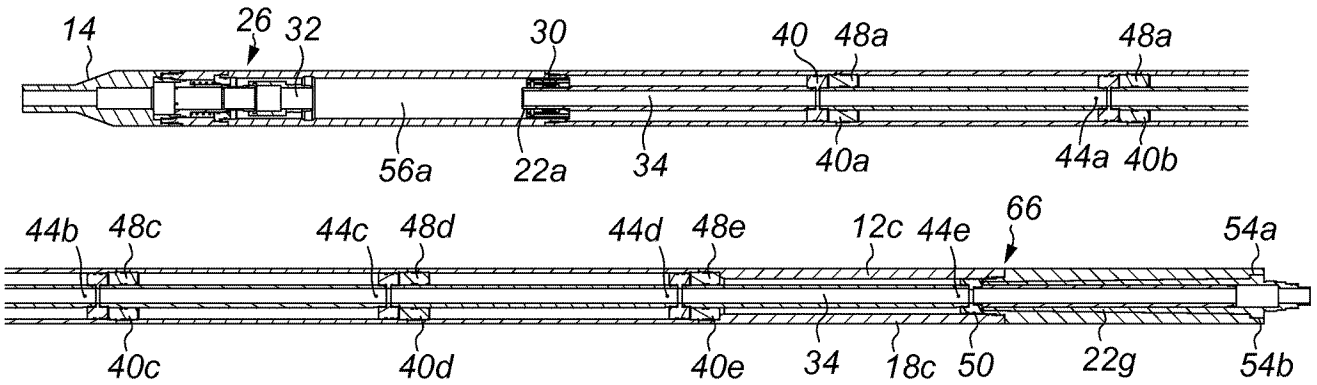
FIG. 4 is a cross section of a side view of the pressure intensifier of FIG. 1 in a second state according to an embodiment of the present invention.

In FIG. 4, the arrangement of the components of intensifier 10 are shown in a second state, subsequent to activation according to an embodiment of the invention. In this embodiment, drive piston 30 has been driven forward as has pistons 40*a-e* such that they now abut against stops 48*a-e* respectively and application piston 50 has been drive forward to abut against wall end stop 69. The force created by hydraulic pressure acting upon pistons 40*a-e* and mandrel segment 22*g* cumulatively acts upon application piston 50 such that the fluid 52 is driven through application bores 54 and into hydraulic fluid delivery tool 96 with such a force that a tubular morphing operation may be actioned with a single actuation of the mechanism. The cumulative pressure against pistons 40*a-e* and mandrel segment 22*g* creates a total force applied to fluid 52 by the movement of piston 50 which is the sum of force from all the pistons 30 and 40*a-e*. The increased thickness of wall 18*c* enables the force of pressure applied to the 22*g* and to application bore 54 to be directed into the tool 96 without damaging or causing deformation of the pressure intensifier 10.

The number of pressure development segments used in the pressure intensifier 10 can be varied depending upon the level of pressure required for a particular use of the intensifier; the more pressure development segments in the form of pistons 40, mandrel sections 22 and stops 48 included in the intensifier 10, the more pressure will can be applied to a hydraulic fluid delivery tool 96. Fewer segments will result in a lower pressure being applied by the mechanism.

Thus the pressure down the tubing string 92 generates a pressure difference across the pistons 40, hence generating a force. This force is used to pressurise the morph fluid 52. Pressure is intensified by the cumulative surface area of each piston used. The number of pistons is thus selected to ensure that sufficient fluid pressure is delivered in a single stroke of the tool so that no resetting mechanism is required.

Figure 5:
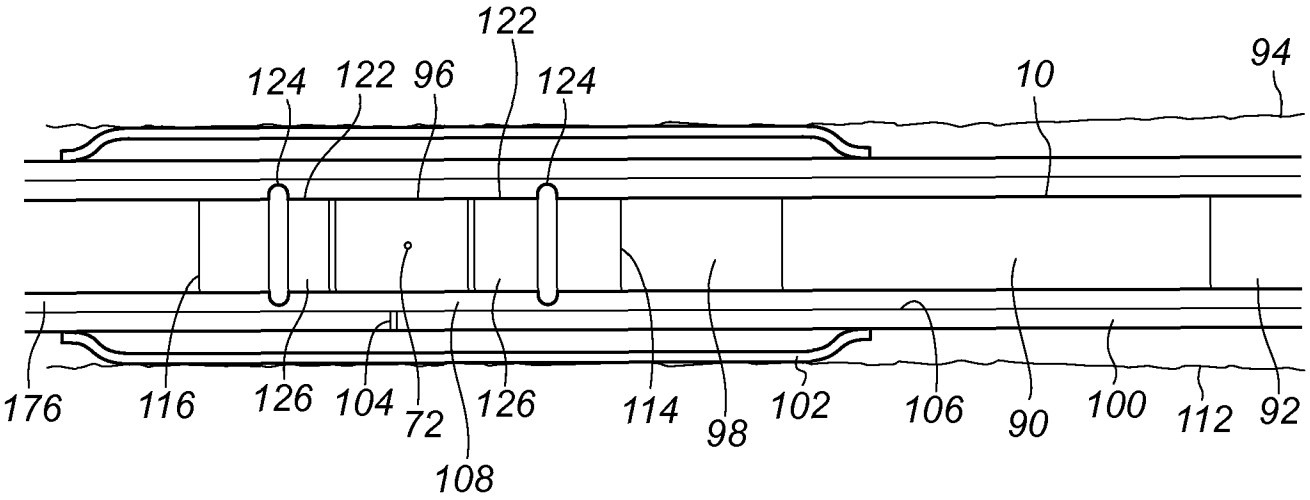
FIG. 5 is a schematic illustration of an assembly including a pressure intensifier for morphing a tubular in a wellbore according to an embodiment of the present invention.

Reference is now made to FIG. 5 of the drawings which illustrates an assembly, generally indicated by reference numeral 90, according to a further embodiment of the present invention. Assembly 90 is mounted on a string 92 and run in a wellbore 94. Assembly 90 includes the pressure intensifier 10 as described hereinbefore with reference to FIGS. 1 to 4. Mounted below the intensifier 10, in the assembly 90, is a pressure distribution tool 98 and a hydraulic fluid delivery tool 96.

In use, the assembly 90 is mounted on the string 92 and run in a tubular being a casing or liner 100. Mounted on the liner 100 is a further tubular arranged as a sleeve 102. A port 104 is located through the liner 100 to access a chamber 104 between the liner 100 and the sleeve 102. The assembly 90 is run in until seal assemblies 122 on the tool 96 straddle the port 104. It will be noted that depending on the length of the tool 96, a large tolerance for this positioning can be built in.

With the assembly 90 in position, fluid is delivered through the bore of the string 92 from surface to the pressure intensifier 10. The fluid is able to pass through the bore 34 of the mandrel 22 and continue through bores in the pressure distribution tool 98 and the hydraulic fluid delivery tool 96 so that a complete throughbore is provided through the assembly 90. When a morph is required, pressure is adjusted at surface to provide the desired operating sequence for the locking mechanism 26. When released the mandrel 22 and pistons 40 move down converting the fluid pressure into a force. This force is cumulative across the pistons and thus a higher force is applied to the application piston 50 so that the morph fluid 52 is delivered through the conduits 54 at high pressure.

The pressure distribution tool 98 takes in the high pressure fluid from the pressure intensifier 10 and provides a first output to deliver fluid at the first pressure for input of the tool 96 and a second output to deliver fluid a second pressure for input to the tool 96. Typically, the second pressure is less than the first as the second pressure is the controlled pressure required to morph the tubular.

The first pressure is used to compress the elastomer bands 124 so that the bands 124 will cross the annular space 176 and seal against the inner surface 106 of the liner 100. A portion 108 of the annular space 176 is thus isolated. Morph fluid 52 under pressure from the distribution tool 98 is delivered to the tool 10 and into the isolated portion 108. The morph fluid 52 travels through the port 104 and acts against the inside surface of the sleeve 102 to morph the sleeve 102 against the borehole wall 112. This is achieved on a single stroke of the pressure intensifier 10. The sleeve 102 thus provides an isolation barrier in the well bore. Both the seals and the morph can be confirmed by monitoring fluid circulation in the annuli. This is possible as the bore 34 through the assembly 90 and the string 92 can be used.

Once the morph is achieved, the pressure is bled down and the seals 122 released. With the elastomers 124 returned, the assembly 90 can be POOH.

The principle advantage of the present invention is that it provides a pressure intensifier for morphing tubulars downhole which uses a force created downhole to generate pressure.

A further advantage of the present invention is that it provides a pressure intensifier for morphing tubulars downhole which can be operated on a single stroke.

It will be appreciated by those skilled in the art that modifications may be made to the invention herein described without departing from the scope thereof. For example, the ports 44 are shown in the above embodiments as small round holes through the mandrel 20. However, the instead of a single hole, each port may comprise a plurality of holes, or the port may be shaped as a slit, a slot or a plurality of slots formed around the circumference of the mandrel 20. The pistons and stops may also have different shapes and configurations.

I claim:

1. A pressure intensifier for morphing tubulars downhole, the pressure intensifier comprising:

an elongate mandrel defining an inner bore, the mandrel being co-axially located within an elongate hollow outer cylindrical body to form a co-axial annular bore therebetween;

at least one piston mounted on an outside of the mandrel, each piston having an annular fluid facing face extending substantially across the annular bore;

at least one input port to enable fluid communication between the inner bore and the annular bore to act upon each face;

at least one stop located on an inner surface of the outer cylindrical body to limit travel of each piston;

morph fluid located in the annular bore between an opposing face of a first piston and a first stop;

wherein the first stop includes one or more delivery ports extending through said elongate hollow outer cylindrical body to deliver the morph fluid at a greater pressure than the pressure of fluid delivered through the inner bore.

2. A pressure intensifier according to claim 1 wherein there is a plurality of pistons arranged along the mandrel.

3. A pressure intensifier according to claim 1 wherein the outer cylindrical body has a first inner diameter which defines a first volume of the annular bore between adjacent stops and wherein, the outer cylindrical body has a second inner diameter at the location of the morph fluid, the second inner diameter being less than the first inner diameter.

4. A pressure intensifier according claim 2 wherein the intensifier includes a locking mechanism, the locking mechanism being arranged to hold the mandrel and pistons in a first position until a morph is required.

5. A pressure intensifier according to claim 1 wherein the intensifier includes a hydraulic fluid delivery tool, the tool comprising upper and lower seals, the seals being operable to radially expand and seal against an inner surface of a tubular at a pair of spaced apart locations in order to isolate an internal portion of the tubular between the seals at a desired location, so that morph fluid can be delivered at high pressure to the location.

6. A pressure intensifier according to claim 5 wherein the delivery ports are arranged to deliver the morph fluid to the location.

7. A method of morphing a tubular downhole, comprising the steps:

(a) connecting a hydraulic fluid delivery tool to a pressure intensifier, the pressure intensifier comprising: an elongate mandrel defining an inner bore, the mandrel being co-axially located within an elongate hollow outer cylindrical body to form a co-axial annular bore therebetween; at least one piston mounted on an outside of the mandrel, each piston having an annular fluid facing face extending substantially across the annular bore; at least one input port to enable fluid communication between the inner bore and the annular bore to act upon each face; at least one stop located on an inner surface of the outer cylindrical body to limit travel of each piston; morph fluid located in the annular bore between an opposing face of a first piston and a first stop; wherein the first stop includes one or more delivery ports to deliver the morph fluid at a greater pressure than the pressure of fluid delivered through the inner bore;

(b) positioning the hydraulic fluid delivery tool at a location in the tubular;

(c) flowing fluids through the inner bore of the pressure intensifier;

(d) passing fluid through the input port(s) to apply a pressure upon the annular fluid facing face(s) of the pistons(s);

(e) forcing the mandrel and pistons along the cylindrical outer body until the piston(s) reaches a stop;

(f) driving morph fluid out of the delivery port(s) at a desired morph pressure by movement of the first piston towards the first stop; and (g) delivering morph fluid to the location and morphing the tubular.

8. A method according to claim 7 wherein, the method includes the step of selecting a number of pistons dependent upon the morph pressure required.

9. A method according to claim 7 wherein the method includes the step of retaining the mandrel and piston(s) in a first position while delivering fluid through the inner bore.

10. A method according to claim 7 wherein the method includes the step of retaining the mandrel and piston(s) in a first position while running a further string through the inner bore.

11. A method according to claim 7 wherein the method includes the steps of:

(h) conducting a first stage release of the mandrel at a preset fluid pressure in the inner bore;

(i) bleeding down fluid pressure in the inner bore to provide a second stage release; and (j) operating the pressure intensifier on fluid pressure in the inner bore being increased again.

12. A method according to claim 7 wherein the morph fluid morphs the tubular between the upper and lower seals.

13. A method according to claim 7 wherein the morph fluid passes through a port in the tubular and enters a chamber formed by an outer tubular arranged as a sleeve on the tubular, the morph fluid morphing the outer tubular.

* * * * *